2/2/85 OR 4,626,380

United States Patent [19]

Baatz et al.

[11] Patent Number: 4,626,380

[45] Date of Patent: Dec. 2, 1986

[54] TRANSPORT AND STORAGE CONTAINER FOR RADIOACTIVE WASTE

[75] Inventors: Henning Baatz; Dieter Rittscher, both of Essen, Fed. Rep. of Germany

[73] Assignee: GNS-Gesellschaft fur Nuklear-Service mbH, Essen, Fed. Rep. of Germany

[21] Appl. No.: 505,228

[22] Filed: Jun. 17, 1983

[30] Foreign Application Priority Data

Jun. 18, 1982 [DE] Fed. Rep. of Germany ..... 3222749

[51] Int. Cl.[4] ..... G21F 5/00

[52] U.S. Cl. ..... 250/506.1; 141/391

[58] Field of Search ..... 250/506.1; 141/391, 141/392

[56] References Cited

U.S. PATENT DOCUMENTS

| | | | |
|---|---|---|---|
| 4,219,735 | 8/1980 | Blum | 250/506.1 |
| 4,234,798 | 11/1980 | Baatz | 250/506.1 |
| 4,236,969 | 12/1980 | Ljubivy | 250/506.1 |
| 4,422,964 | 12/1983 | Capolupo | 250/506.1 |
| 4,456,827 | 6/1984 | Botzem | 250/506.1 |

FOREIGN PATENT DOCUMENTS

| | | |
|---|---|---|
| 7825615 | 1/1979 | Fed. Rep. of Germany . |
| 3026249 | 2/1982 | Fed. Rep. of Germany . |

*Primary Examiner*—Sam Silverberg

*Attorney, Agent, or Firm*—Karl F. Ross; Herbert Dubno

[57] ABSTRACT

A storage and transport container for radioactive waste has an upwardly open vessel having a closed bottom, solid walls, and an open upper mouth. A lid is sealingly engaged over and completely blocks the mouth. This lid is formed with at least one vertically throughgoing passage having a lower end and an upper end. A rigid guide tube fixed to the lid extends down in the vessel from the lower passage end to a location immediately adjacent the bottom of the vessel. Thus the interior of the tube forms a downward continuation of the passage to the location. A flexible feed tube extends along the passage and the continuation thereof and has an upper end screwed to the lid at the upper passage end and a lower end at the location. Thus the vessel can be filled and emptied through this feed tube, which therefore can be an accessory that need not be left on an inactive container, thereby greatly reducing cost per container.

5 Claims, 3 Drawing Figures

TRANSPORT AND STORAGE CONTAINER FOR RADIOACTIVE WASTE

FIELD OF THE INVENTION

The present invention relates to a transport and storage container for radioactive waste. More particularly this invention concerns the storage and transport of spent fuel elements of a nuclear reactor.

BACKGROUND OF THE INVENTION

A standard storage and transport container for radioactive waste has an upwardly open vessel having a closed bottom, solid walls, and an open upper mouth and a lid sealingly engaged over and completely blocking the mouth. A feed tube, through which fluids are fed into or taken out of the vessel interior for cleaning, filling, or inspection purposes, is fixed to the lid. This tube extends down in the vessel to a location immediately adjacent, that is spaced slightly up from, the upper surface of the bottom of the vessel. As the feed tube is still fairly delicate, it is difficult to fit a lid equipped with it to a vessel because if it is bumped at all it can be damaged beyond use.

Such a feed tube is connected in the system of German patent document No. 3,026,249 to a filling, draining, or testing machine by a standard tapered plug that is fitted into the upper feed-tube end and secured by a flange to the lid. Leakage at this joint can be dangerous, so considerable precautions must be taken, usually resulting in extended hookup time and requiring expensive couplings and fittings.

A more effective arrangement is described in German utility model No. 7,825,615. Here a feed-through fitting is provided in the wall or bottom of the vessel, eliminating the need for a tube extending down to the lower limits of the vessel interior where gases are sampled and material is fed in. Unfortunately such a connection is quite expensive to install, and is itself a very costly item, so its use is limited to very large containers.

OBJECTS OF THE INVENTION

It is therefore an object of the present invention to provide an improved radioactive-waste storage and transport container.

Another object is the provision of such a radioactive-waste storage and transport container which overcomes the above-given disadvantages, that is which is relatively simple and inexpensive, yet which makes feeding, whether for filling, emptying, cleaning, or sampling purposes, a fluid into or out of the container relatively easy.

SUMMARY OF THE INVENTION

A storage and transport container for radioactive waste according to the invention has an upwardly open vessel having a closed bottom, solid walls, and an open upper mouth. A lid is sealingly engaged over and completely blocks the mouth. This lid is formed with at least one vertically throughgoing passage having a lower end and an upper end. A rigid guide tube fixed to the lid extends down in the vessel from the lower passage end to a location immediately adjacent the bottom of the vessel. Thus the interior of the tube forms a downward continuation of the passage to the location. A feed tube extends along the passage and the continuation thereof and has an upper end screwed to the lid at the upper passage end and a lower end at the location. Thus the vessel can be filled and emptied through this feed tube, which therefore can be an accessory that need not be left on an inactive container, thereby greatly reducing cost per container.

According to a feature of this invention the feed tube is provided at the location with a foot valve. In addition for most complete possible draining, the bottom of the vessel is formed at the location with an upwardly open sump-forming recess. The foot valve reaches all the way down into this sump, below the plane of the rest of the bottom of the vessel.

In accordance with another feature of the invention the feed tube is flexible. Its outer diameter is smaller than that of the guide tube so it can be slipped therethrough. In addition this feed tube is provided with a rigid fitting threaded into the upper passage end. The vessel and lid are centered on an axis and the upper and lower passage ends are axially out of line with each other. The passage extends between these ends at an angle to the axis and the guide tube extends substantially parallel to the axis. Such an inclined passage minimizes the passage of gamma rays through the lid.

The device according to this invention also has a second lid fitted into the mouth above the first-mentioned lid.

DESCRIPTION OF THE DRAWING

The above and other features and advantages will become more readily apparent from the following, reference being made to the accompanying drawing in which.

SPECIFIC DESCRIPTION

Figure 1:
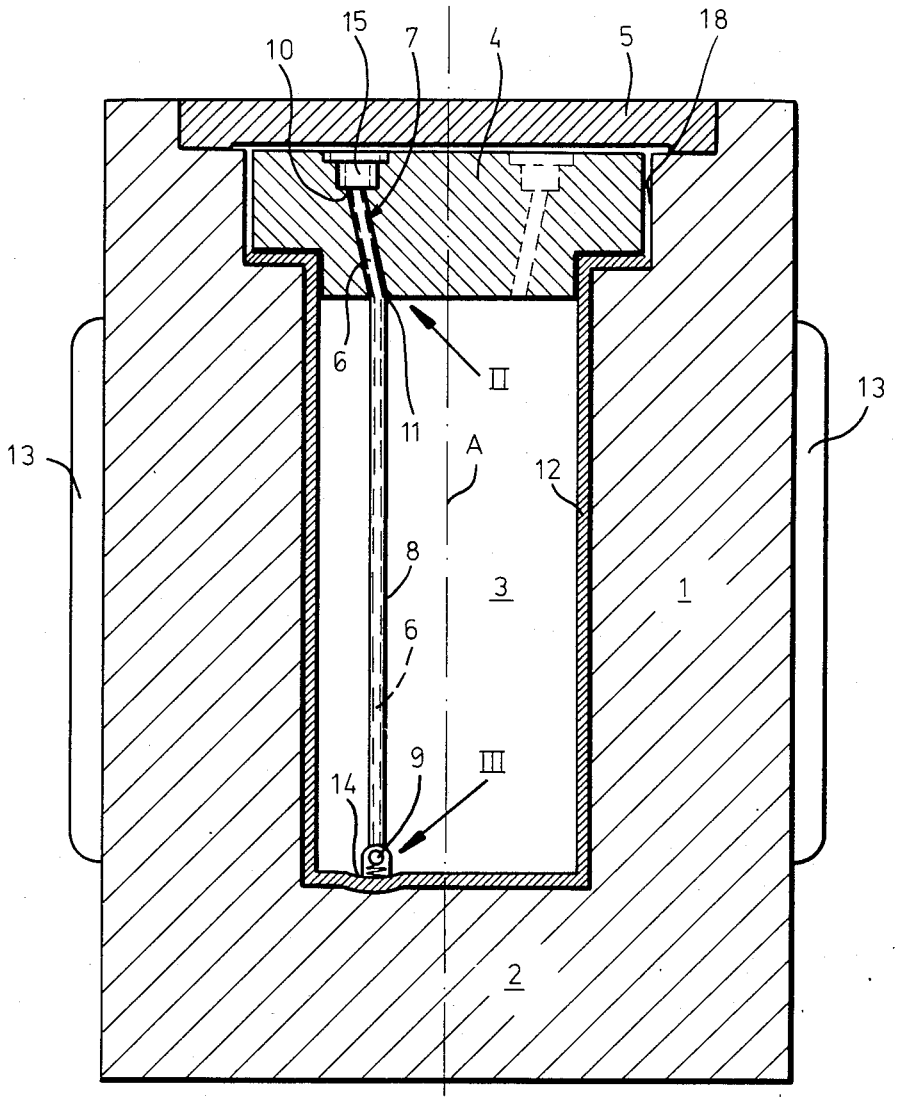
FIG. 1 is a vertical and axial section through the container according to this invention.

As seen in FIG. 1 a massive storage and transport vessel 1 for spent nuclear-fuel rods has a closed base or bottom 2 and defines an upwardly open cylindrical interior 3 terminating at a mouth 18 formed with successively larger shoulders. A main shield plug or lid 4 sits in the mouth 18 on the smaller lower shoulder, and a second protective lid or cover 5 fits above it. Internally the vessel 1 is provided with a coating 12 of an inorganic paint. Externally the vessel 1 can be cylindrical or square, and can have cooling fins 13.

Figure 2:
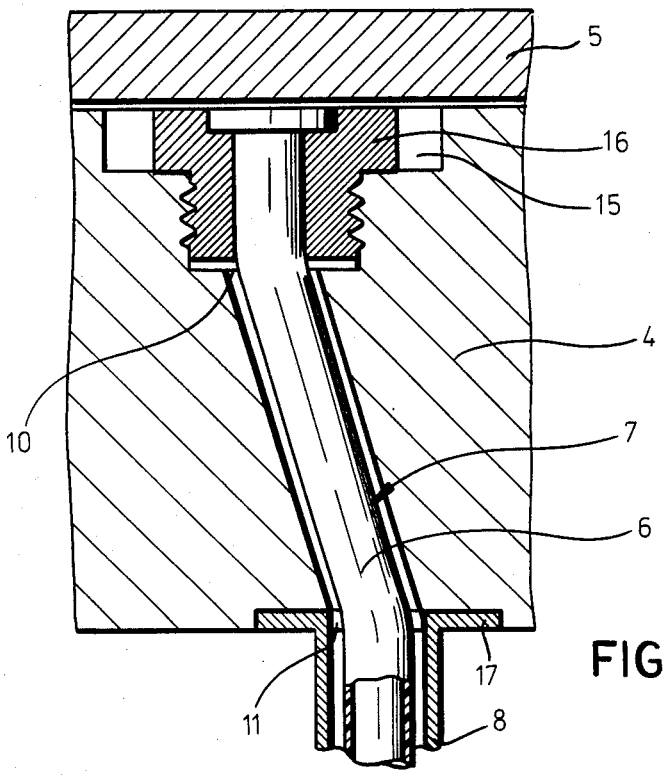
FIGS. 2 and 3 are large-scale views of the details indicated respectively at arrows II and III of FIG. 1.
Figure 3:
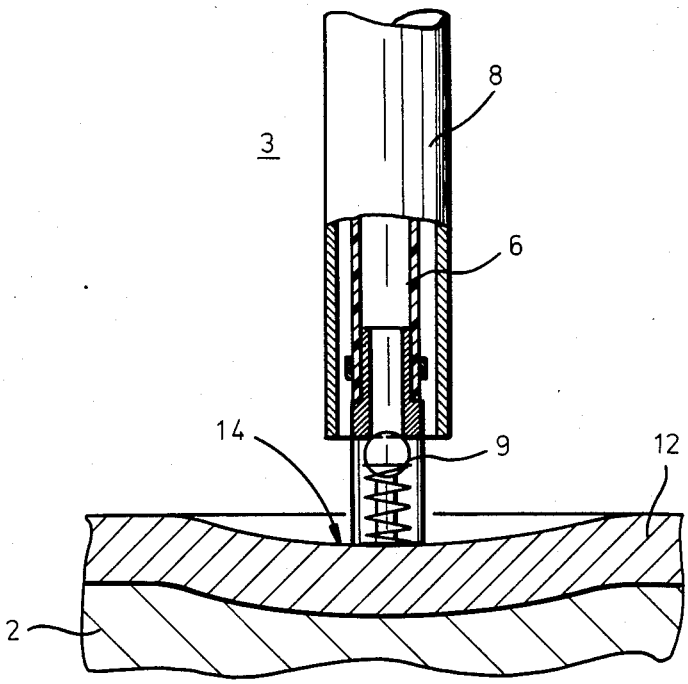

The lid 4 is formed as also shown in FIG. 2 with a vertically throughgoing bore or passage 7 that is inclined to the symmetry axis of the container 1 so that its upper end 10 is spaced radially further from this axis A than its lower end 11, but is straight between these ends 10 and 11. A rigid guide tube 8 extending parallel to the axis A in the interior 3 has a flange 17 bolted to the underside of the lid 4 at the lower passage end 11. The inside diameter of this tube 8 is the same as that of the passage 7 and its lower end terminates as shown in FIG. 3 a short distance above a recess or sump 14 formed in the bottom 2 of the vessel 1.

A flexible feed tube 6 of an outer diameter substantially smaller than the inner diameter of the tube 8 and passage 7 has as shown in FIG. 2 an upper end provided with a fitting 16 screwed into a stepped and threaded counterbore 15 at the upper passage end 10. Its lower end as shown in FIG. 3 is provided with a foot valve 9, here a simple ball-type check valve, that sits directly on the base of the interior 3 in the sump 14. This valve could be operated by engagement with the floor 2, or could be actuated from outside, as for example by means of a flexible rod slid down inside the tube 6.

The vessel 1 is normally filled and then the cap 4 is fitted onto it. The rigid tube 8 can be pushed down through the contents with little difficulty. Then the feed tube 6 can be slid down the tube 8 to allow sampling of the fluids inside the vessel 1, or to allow a fluid to be filled into the vessel. Once the contents are deemed safe, the tube 6 can be withdrawn for use elsewhere.

Thus this tube 6 is reusable, making a substantial saving in costs since it need not be in place for the full life of the vessel. The tube 8 can be of any simple but rugged construction, and need not even form a tight seal, so that it can be an inexpensive item. It is also possible for sensors to be mounted directly in the fitting 16, or for this fitting 16 to form a standard part or plug-in component of a testing, emptying, or filling machine. Since the fitting 16, tube 6, and valve 9 are reusable they can be of high-grade construction without increasing the unit container cost appreciably.

We claim:

1. A storage and transport container for radioactive waste, the container comprising:

an upwardly open vessel having a closed bottom, solid walls, and an open upper mouth;

a lid sealingly engaged over and completely blocking the mouth, the lid being formed with at least one vertically throughgoing passage having a lower end and a threaded upper end, the vessel and lid being centered on an axis and the upper and lower passage ends being axially out of line with each other, the passage extending between these ends at an angle to the axis;

a rigid guide tube fixed to the lid and extending down in the vessel from the lower passage end to a location immediately adjacent the bottom of the vessel, whereby the interior of the tube forms a downward continuation of the passage to the location;

a feed tube extending along the passage and the continuation thereof and having an upper end provided with a rigid fitting sealingly but releasably screwed to the lid at the threaded upper passage end and a lower end at the location, whereby the vessel can be filled and emptied through this feed tube; and a foot valve at the lower end of the feed tube, the tubes and valve being so dimensioned and the feed tube being sufficiently flexible that the feed tube and valve can be pushed down through the rigid guide tube, the valve engaging the bottom of the vessel when the upper feed-tube end is threaded into the upper passage end.

2. The radioactive-waste storage and transport container defined in claim 1 wherein the bottom of the vessel is formed at the location with an upwardly open sump-forming recess.

3. The radioactive-waste storage and transport container defined in claim 1 wherein the guide tube extends substantially parallel to the axis.

4. The radioactive-waste storage and transport container defined in claim 1, further comprising a second lid fitted into the mouth above the first-mentioned lid.

5. The radioactive-waste storage and transport container defined in claim 1 wherein the feed tube is of an outside diameter that is substantially smaller than the inside diameter of the guide tube.

* * * * *